US008240478B2

(12) United States Patent
Philips

(10) Patent No.: US 8,240,478 B2
(45) **Date of Patent: *Aug. 14, 2012**

(54) MULTI-PRODUCT CONTAINER AND CONTAINER BLANK

(75) Inventor: Nicholas A. Philips, Sugar Grove, IL (US)

(73) Assignee: International Paper Company, Memphis, TN (US)

( * ) Notice: Subject to any disclaimer, the term of this patent is extended or adjusted under 35 U.S.C. 154(b) by 13 days.

This patent is subject to a terminal disclaimer.

(21) Appl. No.: 12/779,311

(22) Filed: May 13, 2010

(65) Prior Publication Data

US 2011/0031304 A1 Feb. 10, 2011

Related U.S. Application Data

(63) Continuation of application No. 11/239,902, filed on Sep. 30, 2005, now Pat. No. 7,757,860.

(51) Int. Cl.
*B65D 5/50* (2006.01)

(52) U.S. Cl. ..... 206/763; 206/217; 206/562; 229/186; 229/904

(58) Field of Classification Search ..... 206/193–197, 206/217, 562–565, 541, 756, 759, 763, 764; 229/150, 125.08, 160, 186, 232, 904, 906
See application file for complete search history.

(56) References Cited

U.S. PATENT DOCUMENTS

| | | | | |
|---|---|---|---|---|
| 1,448,864 | A | 4/1923 | Pinkerton | |
| 3,642,125 | A | 2/1972 | Johnson | |
| 4,757,937 | A | 7/1988 | Maio et al. | |
| 5,183,201 | A * | 2/1993 | Gulliver | 229/117.12 |
| 5,205,474 | A | 4/1993 | Stuart et al. | |
| 5,265,796 | A | 11/1993 | Gulliver et al. | |
| 5,297,726 | A | 3/1994 | Detzel | |
| 5,337,951 | A | 8/1994 | Roccaforte | |
| 5,788,081 | A | 8/1998 | Bates | |
| 6,568,586 | B1 * | 5/2003 | VanEsley et al. | 229/120.18 |
| 6,676,010 | B1 | 1/2004 | Roseth et al. | |
| 7,004,314 | B2 | 2/2006 | Pucillo et al. | |
| 7,264,123 | B2 * | 9/2007 | Reed | 206/765 |
| 2004/0200891 | A1 | 10/2004 | Correll | |
| 2004/0222109 | A1 * | 11/2004 | Pucillo et al. | 206/216 |

* cited by examiner

*Primary Examiner* — Luan K Bui

(57) ABSTRACT

The present invention is directed to a multi-product container and container blank. In accordance with the present invention, a single sheet of foldable material is cut and scored to define a container blank. The blank includes a bottom panel, a front panel, a back panel, opposed side panels and a plurality of corner panels. Also, a top panel is attached to the back panel opposite said bottom panel. A fold over cup panel is attached to the front panel opposite the bottom panel. The cup panel does not include additional panels or tabs opposite the front panel. An optional cup receptacle is formed in the cup panel. As fanned, the front panel, back panel opposed side panels and plurality of corner panels are hingedly attached to said bottom panel via unperforated score lines.

4 Claims, 2 Drawing Sheets

MULTI-PRODUCT CONTAINER AND CONTAINER BLANK

CROSS-REFERENCE TO RELATED APPLICATIONS

This application is a continuation of U.S. patent application Ser. No. 11/239,902 filed Sep. 30, 2005, U.S. Pat. No. 7,757,860.

FIELD OF THE INVENTION

This invention relates generally to containers and, more specifically, to multi-product containers and container blanks.

BACKGROUND OF THE INVENTION

Multi-product containers are typically used to ship or contain related products. For example, in the food industry, the various products may be pieces of chicken or other meats combined with containers for sauce or other seasoning material. Containers of this style typically have one container region for a first product and another container region for a second product.

There are several problems with the current designs. Initially, the current designs are overly complex to manufacture, are not structurally sound, or both. Also, the current designs typically are not leak or sift proof and therefore are limited in application. Finally, the current designs typically do not have top panels that cover all of the regions containing product. As such, the current design applications are limited by the container's failure to provide a sanitary barrier over all of the products within the container.

SUMMARY OF THE INVENTION

The present invention is directed to a multi-product container and container blank. In accordance with the present invention, a single sheet of foldable material is cut and scored to define a container blank that may be shipped to a point of use in a flattened condition and erected into usable condition at the point of use without requiring adhesive or other separate fasteners. The blank includes a bottom panel, a front panel, a back panel, opposed side panels terminating in outer free edges, and a plurality of corner gusset panels. Also, a top panel is attached to the back panel opposite said bottom panel. A fold over cup panel is attached to the front panel opposite the bottom panel. The cup panel does not include additional panels or tabs opposite the front panel. An optional cup receptacle is formed in the cup panel. As formed, the front panel, back panel, opposed side panels and plurality of corner panels are hingedly attached to said bottom panel via unperforated score lines.

More specifically, a container blank according to the invention that can be quickly and easily set up without requiring use of separate fastening means to make a sift-resistant and leak-resistant container for transporting products, comprises a one-piece sheet of foldable material cut and scored to define a bottom panel having opposite side edges defined by first and second spaced apart parallel fold creases extending transversely across the sheet of material. Opposite end edges of the bottom panel are defined by third and fourth spaced apart parallel fold creases extending perpendicular to the first and second fold creases and intersecting the first and second fold creases at locations inset from adjacent edges of said blank. The distance between the third and fourth fold creases defines a length dimension of the bottom panel. First and second side panels are foldably joined to opposite ends of the bottom panel along the third and fourth fold creases, respectively, and front and back panels are foldably joined to opposite side edges of the back panel along the first and second fold creases, respectively. The front and back panels have a length dimension greater than the length dimension of the bottom panel. Corner panels are integrally foldably connected between adjacent ends of the side panels and the front and back panels, said corner panels being joined to respective adjacent ends of the side panels along fold creases extending collinearly with the first and second fold creases, and joined to respective adjacent ends of the front and back panels along fold creases extending diagonally outwardly from the intersections of the first and second fold creases with the third and fourth fold creases to an adjacent end edge of a respective front and back panel. A top panel is foldably connected to an edge of the back panel opposite the edge connected with the bottom panel, and the top panel has a length dimension the same as the length dimension of the front and back panels but greater than the length dimension of the bottom panel, whereby in a container erected from the blank the top panel covers the container and rests on and is supported by the side panels.

The present invention further includes a container that is held in erected condition without the use of adhesives or other separate fasteners. The container comprises a bottom panel with opposed front and back panels, opposed side panels terminating in free upper edges, and corner gusset panels connected between adjacent ends of the side panels and respective front and back panels. A top panel is attached to said back panel opposite said bottom panel and has a top tab on its free edge. A fold over cup panel is attached to the front panel opposite the bottom panel and a locking slot is formed at the folded connection of the cup panel with the front panel. As formed, the cup panel lies in a plane substantially parallel to the top panel and bottom panel, and the top panel overlies the cup panel and is supported on the free upper edges of the side panels, with the top tab engaged in the locking slot.

BRIEF DESCRIPTION OF THE DRAWINGS

Various embodiments of the present invention are described in detail below with reference to the following drawings.

DETAILED DESCRIPTION OF THE INVENTION

The present invention will now be described with reference to the accompanying drawings. The present invention is directed to a multi-product type container that utilizes a fold over cup panel with optional cup receptacles and a fully coving top panel. One suitable embodiment of a multi-product type container 50 constructed in accordance with aspects of the present invention is illustrated in FIGS. 1-4. Specific details of the blank 20 and resulting container 50 are described with more particularity below.

Figure 1:
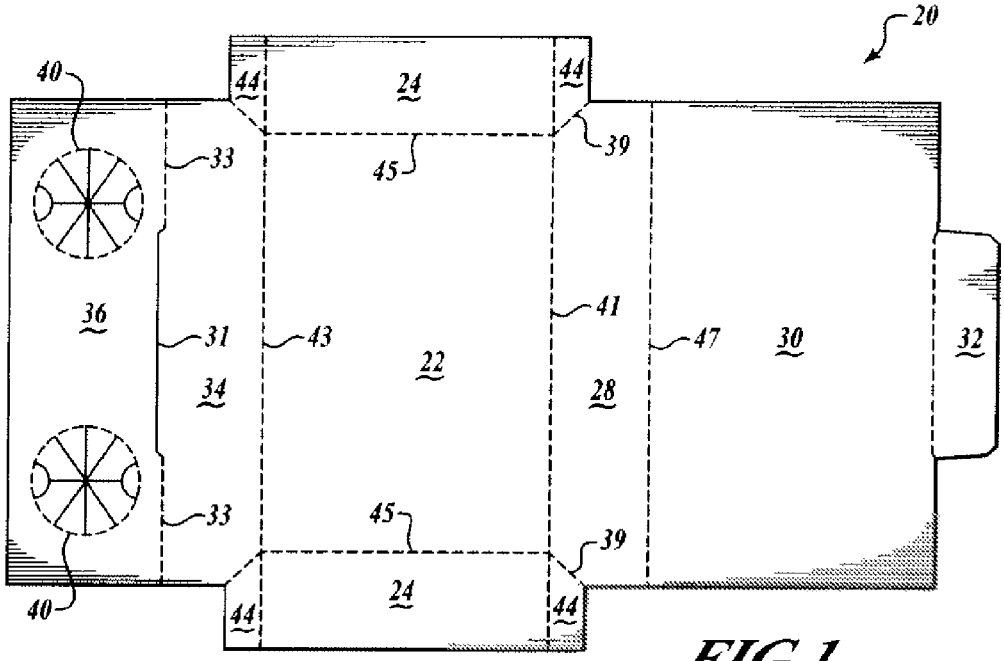
FIG. 1 is a plan view of a single piece container blank formed in accordance with the present invention.
Figure 2:
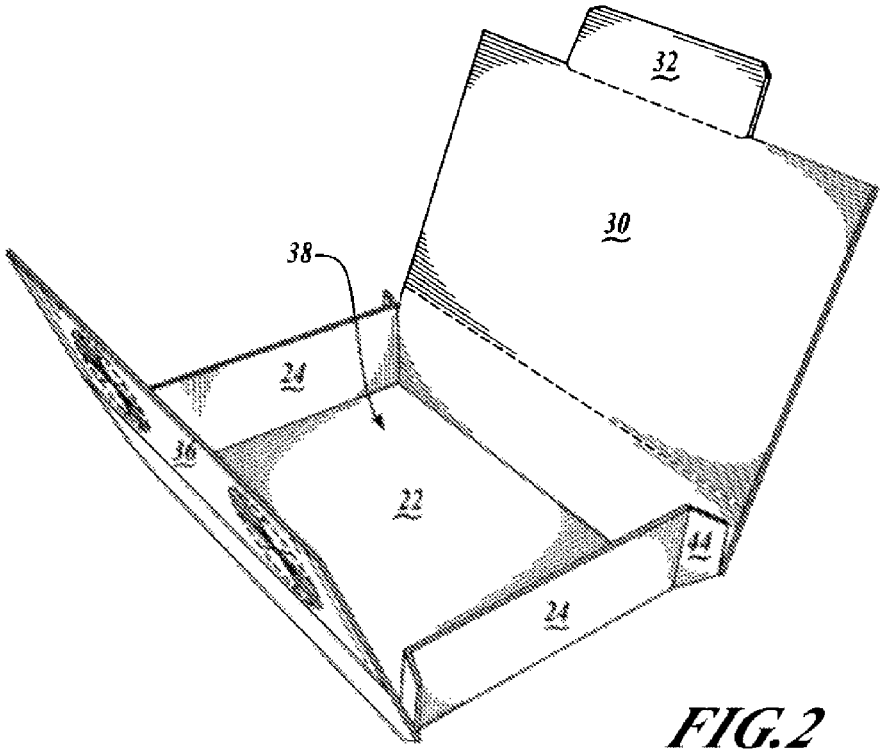
FIG. 2 is a perspective view of a partially assembled container according to the present invention.
Figure 3:
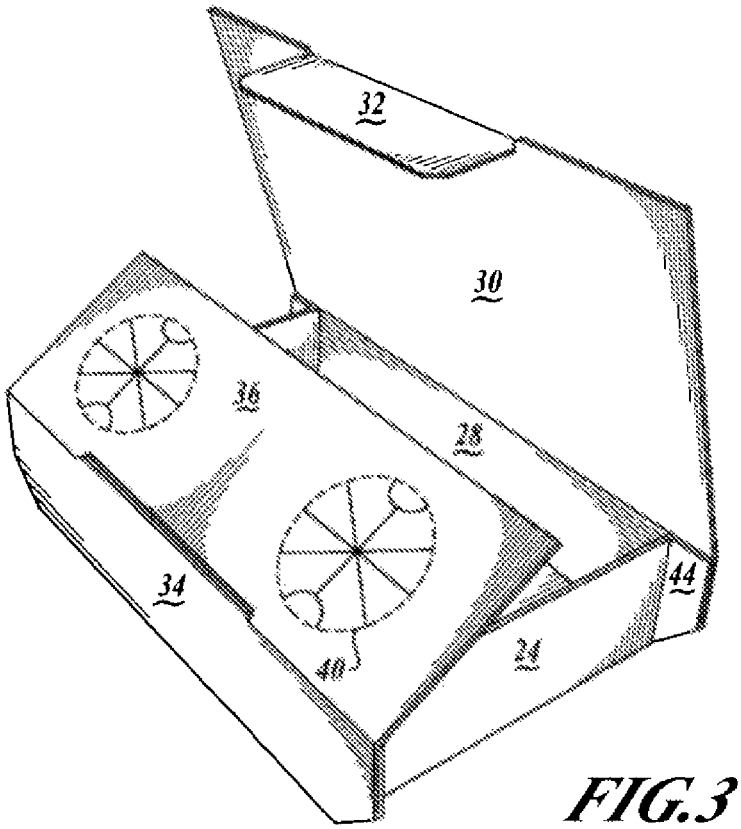
FIG. 3 is another perspective view of a partially assembled container according to the present invention; and, FIG. 4 is a perspective view of an assembled container according to an aspect of the present invention depicted in FIG. 1.

FIG. 1 depicts a blank 20 used to form the container 50. The blank 20 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard. The blank 20 is cut and scored, perforated or otherwise formed to include a plurality of panels that when assembled form container 50. In all FIGURES, like numbers indicate like parts. Additionally, cut lines are shown as solid lines, score lines as dashed lines, and lines of perforation as broken lines. For the purpose of further description herein, the downward direction is defined as the direction perpendicular to bottom panel 22 that corresponds to the outer surface of the bottom panel when the container has been erected. The upward direction is defined as the direction perpendicular to the bottom panel 22 that corresponds to the inner surface of the bottom panel when the container has been erected.

Referring now to FIG. 1, the blank 20 includes a bottom panel 22. Attached to the bottom panel 22 along fold lines 45 are opposed side panels 24. A front panel 34 is attached to the bottom panel 22 along fold line 43. Also, a back panel 28 is attached to the bottom panel 22, opposite the front panel 34, along fold line 41. A top panel 30 is attached to the back panel 28 opposite the bottom panel 22. The top panel 30 includes a top tab 32 hingedly connected with the top panel 30, opposite the back panel 28.

With reference to FIG. 1, interposed between the various side panels 24, back panel 28, and front panel 34, and in connection with the bottom panel 22 are corner panels 44. Corner fold lines 39 serve to attach the relative panels together. Typically, the corner fold lines 39 attach the relative panels together by a bellow told or other type scored fold.

A unique aspect of the present invention is the nature of the attachment of the various side panels 24, back panel 28, and front panel 34 and corner panels 44 to the bottom panel 22. Fold lines 41, 43, 45 corner fold lines 39 are score lines, and not lines of perforation or cut lines. The fold lines 41, 43, 45 and corner fold lines 39 do not have any open passage way between the relative panels. In this fashion, the container 50 is sift and leak proof when formed. By sift proof it is meant that the container 50 does not allow granular element to pass though the bottom panel 22 and surrounding panels. By leak proof it is meant, that the container 50 does not allow a liquid element to pass though the bottom panel 22 and surrounding panels.

A fold over cup panel 36 is attached to the front panel 34, opposite the bottom panel 22.

The cup panel 36 may be a solid panel; however, the cup panel 36 optionally includes at least one cup receptacle 40 formed therethrough. In an embodiment, the cup receptacle 40 includes a "starfish" or other shaped cut elements configured to allow the insertion of a container (not shown) into the cup receptacle 40. The relative size and geometry of the cup receptacle(s) 40 is variable and will be dependent upon the size and geometry of the item to be place in the cup receptacle 40. Positioned between the front panel 38 and the cup panel 36 is a locking slot 31. The locking slot 31 is sized to accommodate the top tab 32 and is bounded by co-axial fold lines 33.

FIGS. 2-5 illustrate the erection of the container 50 from the blank 20. Initially the back panel 28, front panel 34 and side panels 24 are folded upwards around fold lines 41, 43, 45 respectively. In folding the blank 20 in this manner, a first container open surface area 38 is created. By first container open surface area 38, it means the 2-D space bounded by the top surface of the side panels 24, back panel 28 and front panel 34 of the erect container 50.

The fold over cup panel 36 is folded inwardly such that the cup panel 36 is substantially parallel to the bottom panel 22. As can be seen from the FIGURES, the length of the cup panel 36 measured in a direction parallel to fold line 43, is greater than the distance between the respect fold lines 45, measured along the same line. As such, the cup panel 36 rests upon the top of side panels 24, and front panel 34. In this manner, the cup panel 36 provides a stable platform for products placed within the cup receptacles 40 without significantly reducing the overall container volume.

Figure 4:
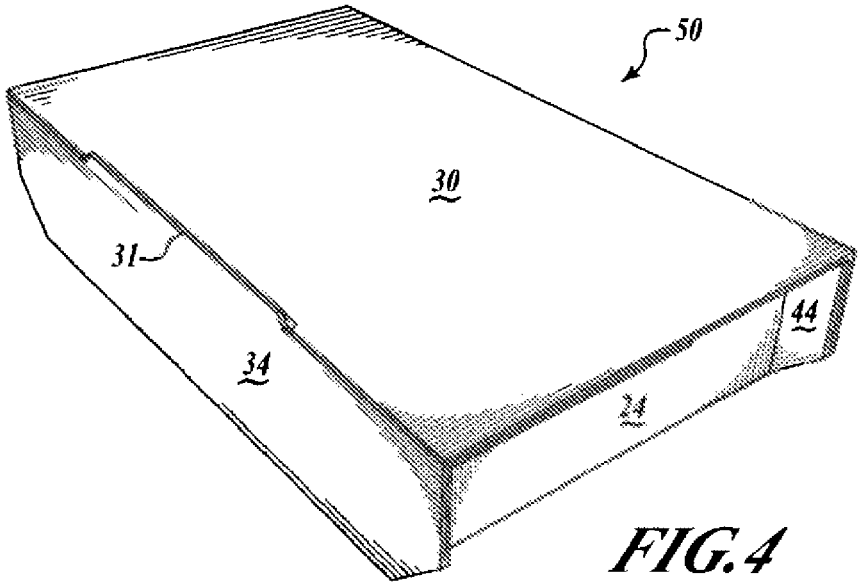

As best seen in FIGS. 4 and 5, the assembled fold over cup panel 36 creates a second container open surface area 39. By second container open surface area 39, it means the 2-D space bounded by the top surface of the side panels 24, back panel 28 and the cup panel's inner edge of the erect container 50. The top panel 30 may then be folded to cover the other panels. The top tab 32 may be inserted into the top panel slot 31 to lock the container 50.

The top panel 30 is configured to completely cover the entire rest of the container 50. In this manner, the top panel 30 serves as a sanitary barrier for products contained within the container (not shown). Further, the top panel 30 serves to secure any objects placed with the cup receptacles (not shown).

The present invention may be used in a variety of manners. By way of non-limiting example, the container 50 may be used in the food industry. In an application items such as chicken wings or nuggets, dipping breads, French fries, or onion rings may be placed in the container 50, while sauce containers (not shown) may be stored in the cups 40. By way of further non-limiting example, the present invention is suitable for use in the arts and crafts industry. In this manner, brushes or figurines (not shown) or the like may be held in the container 50 while, paints (not shown) or other such items are supported in the cups 40. Those skilled in the art will appreciate that the present invention is suitable for many other uses as well.

Any variety of additional elements may be included, such as, without limitation, vents, specialized liners or grease barriers, etc., without departing from the spirit and scope of the present invention. Similarly, rounding or otherwise trimming the various 25 panels is considered within the scope of the instant invention.

While various embodiments of the invention has been illustrated and described, as noted above, many changes can be made without departing from the spirit and scope of the invention. Accordingly, the scope of the invention should be determined entirely by reference to the claims that follow.

What is claimed is:

1. A sift-resistant and leak-resistant container formed from a single unitary sheet of cut and scored foldable material that can be shipped in a flattened condition to a point of use and quickly and easily erected without use of adhesive or other separate fastening means to hold the container in erected condition, the container comprising:

a bottom panel having opposite side edges and opposite end edges;

opposed side panels on respective opposite end edges of the bottom panel, the side panels each terminating in a free upper edge;

opposed front and back panels on the opposite side edges of the bottom panel, the front and back panels extending perpendicular to the side panels and projecting at opposite ends thereof beyond the side panels;

gusset corner panels connecting adjacent ends of the side panels and the front and back panels, defining closed leak-resistant and sift-resistant corners in the container, the gusset corner panels being trapezoidally shaped and foldably connected to respective ends of the side panels by fold creases extending collinearly with the opposite side edges of the bottom panel, and foldably connected to respective adjacent ends of the front and back panels by fold creases extending diagonally from the ends of the front and back panels to adjacent corners of the bottom panel; and a top panel foldably connected to and right angle to a top edge of the back panel resulting in an L-shaped free edge, which protrudes outward substantially from both of the side walls, the top panel terminating in opposite free side edges and having length and width dimensions to cover the container and to rest on and be supported by the free upper edges of the side panels with the free side edges of the top panel extending beyond the side panels to prevent the top panel from being depressed into an interior space of the container and wherein the footprint of the top panel being substantially larger than the footprint of the bottom panel.

2. The sift-resistant and leak-resistant container of claim 1, further comprising:

a cup panel foldably connected to a top edge of the front panel, the cup panel having length and width dimensions to overlie at least a portion of the container and to rest on and be supported by the free upper edges of the side panels.

3. The sift-resistant and leak-resistant container of claim 2, wherein:

at least one cup receptacle is formed in the cup panel by cut elements configured to allow the insertion of a container into the cup receptacle.

4. The sift-resistant and leak-resistant container of claim 3, wherein:

a locking slot is at the folded connection of the cup panel with the front panel; and a top tab is on an edge of the top panel opposite the edge connected with the back panel, the top tab being adapted to engage in the locking slot to lock the top panel in closed position over the container.

* * * * *